United States Patent [19]

Iijima et al.

[11] Patent Number: 4,683,013

[45] Date of Patent: Jul. 28, 1987

[54] METHOD FOR PRODUCING A SHADOW MASK FOR A COLOR CATHODE RAY TUBE

[75] Inventors: Kenzaburou Iijima; Yoshinori Hayashi, both of Hamamatsu, Japan

[73] Assignee: Nippon Gakki Seizo Kabushiki Kaisha, Japan

[21] Appl. No.: 796,917

[22] Filed: Nov. 12, 1985

[30] Foreign Application Priority Data

Nov. 24, 1984 [JP] Japan ..... 59-248461

[51] Int. Cl.[4] ..... H01F 1/02

[52] U.S. Cl. ..... 148/102; 445/47

[58] Field of Search ..... 148/100, 101, 102, 103; 75/126 H; 445/47

[56] References Cited

U.S. PATENT DOCUMENTS

| | | | |
|---|---|---|---|
| 4,093,477 | 6/1978 | Iwata et al. | 148/108 |
| 4,194,932 | 3/1980 | Iwata | 148/102 |
| 4,263,044 | 4/1981 | Inoue | 75/126 C |

FOREIGN PATENT DOCUMENTS

| | | | |
|---|---|---|---|
| 59-107024 | 6/1984 | Japan | 148/102 |
| 59-107025 | 6/1984 | Japan | 148/102 |

*Primary Examiner*—John P. Sheehan

*Attorney, Agent, or Firm*—Ostrolenk, Faber, Gerb & Soffen

[57] ABSTRACT

In production of a shadow mask for a color cathode ray tube from spinodal decomposition type magnet alloys, application of two staged agings before shaping successfully avoids thermal deformation of the product.

3 Claims, No Drawings

METHOD FOR PRODUCING A SHADOW MASK FOR A COLOR CATHODE RAY TUBE

BACKGROUND OF THE INVENTION

The present invention relates to method for producing a shadow mask for a colour cathode ray tube, and more particularly relates to an improvement in production of a shadow mask for a colour cathode ray tube from spinodal decomposition type magnet alloys.

It is basically required for a shadow mask for a colour picture tube to exhibit high image discrimination with high brightness.

In order to meet this requirement, the U.S. Pat. No. 4,135,111 proposes an after-focusing type cathode ray tube. In the construction of this prior proposal, a magnetic field is generated in an electronic beam passage through a shadow mask in order to promote focusing of electronic beams and enrich the rate of passage of the electronic beams through the shadow mask, thereby obtaining high brightness. In order to enable generation of such magnetic field, the shadow mask is made of magnetic materials such as Cu-Ni-Co alloys or Cu-Ni-Fe alloys. However, the rate of thermal expansion of such magnetic material is in general very high. For example, it amounts to about $14\times10^{-6}$/°C. Such high rate of thermal expansion allows undesirable doming due to thermal deformation of the shadow mask, thereby seriously degrading colour purity of the image obtained.

As a substitute for such highly expandable alloys, the use of spinodal decomposition type magnet alloys of lower rate of thermal expansion has already been employed in the field. Such materials have excellent workability and their rate of thermal expansion is about $10\times10^{-6}$/°C.

In conventional production of a shadow mask from spinodal decomposition type magnet alloys, the material is first shaped into a curved configuration of the shadow mask and spinodal decomposition is effected after aging. During this process, strain evolved during heat treatment causes deformation of the original configuration. As a consequence, the electronic beam passage is biased from the correct position, thereby causing undesirable colour slip. Thus, the conventional process failed to produce shadow masks well suited to actual use.

SUMMARY OF THE INVENTION

It is the object of the present invention to produce a shadow mask for a colour cathode ray tube with high dimensional preciseness from spinodal decomposition type magnet alloys.

In accordance with a basic aspect of the present invention, a spinodal decomposition type magnet alloy of a specified composition is subjected, after solution treatment, to two staged agings each under specified conditions and, finally, shaping into a curved configuration of a shadow mask with provision for electronic beam passage therethrough.

DESCRIPTION OF THE PREFERRED EMBODIMENTS

For ideal magnetic operation an after-focusing type shadow mask should have a coersive force (Hc) in a range from 20,000 to 64,000 A/m. For smooth shaping, a shadow mask of the foregoing type should have an elongation after aging of 6% or more.

The spinodal decomposition type magnet alloy used for the present invention should contain 5 to 15 wt% of Co, 20 to 35 wt% of Cr and Fe in balance. Preferably, it may further contain 0.1 to 2 wt% of at least one of Ti, V, Zr, Nb, Mo, W, Mn, Ni, Si, Cu, Zn and Ta. Use of a spinodal decomposition type magnet alloy of such a composition assures production of a shadow mask of the above-described magnetic characteristics and elongation.

After molten into a cast block, the material is subjected to hot rolling, cold rolling, annealing at about 1,000° C., solution treatment at about 1,000° C. and cold rolling in order to obtain a plate.

The plate is then subjected to two staged agings whose conditions are key to successful production.

The primary aging is started at a temperature of 660±5° C. and this temperature is maintained for a period of 10 to 15 min. Thereafter, cooling is carried out at a speed of 80±10° C./Hr. When started at a temperature below 655° C., no desired magnetic characteristics can be obtained. When the temperature exceeds 665° C., no sufficient elongation can be obtained. Similarly, no sufficient elongation can be obtained when the cooling speed falls short of 70° C./Hr; no desired magnetic characteristics can be obtained when the cooling speed exceeds 90° C./Hr.

The secondary aging is started at a temperature of 635±5° C. and terminated at a temperature of 560±10° C. The cooling speed is 8° to 20° C./Hr. When started at a temperature below 630° C., no sufficient elongation is obtained. When the temperature exceeds 640° C., no desired magnetic characteristics can be obtained. Any cooling speed below 8° C./Hr results in insufficient elongation. When the cooling speed exceeds 20° C./Hr, insufficient magnetic characteristics are obtained. When terminated at any temperature below 550° C., no sufficient elongation can be obtained. When terminated at any temperature above 570° C., no desired magnetic characteristics can be obtained.

After the agings, the plate is shaped into the curved configuration of a shadow mask. Finally an electronic beam passage is formed through the curved configuration and a four magnetic pole electrode is formed on the periphery of the passage to obtain the shadow mask.

Preferably, the curvature of the shadow mask should be designed so as to suppress doming due to thermal deformation of the material.

Since shaping is carried out after agings, no strain is caused by the heat evolved during shaping and, as a consequence, shaping can be carried out with high preciseness. Such high preciseness in shaping enables formation of a subtle curvature well suited for suppression of doming.

EXAMPLE

A cast block was prepared from a spinodal decomposition type magnet alloy which contained 12 wt% of Co, 25 wt% of Cr, 0.5 wt% of Ti and Fe in balance. By hot forging, a strip of 5 mm thickness and 400 mm width was formed from the cast block. Subsequent hot rolling formed a strip of 1 mm thickness and cold rolling formed a strip of 0.3 mm thickness. After annealing at 1050° C. in a reductive environment, the strip was subjected to solution treatment and cut into several thin plates.

The primary aging was started at a temperature of 660° C. which was maintained for 10 min. Cooling speed was 75° C./Hr. The secondary aging was started at a temperature of 630° C. Cooling was carried out at a speed of 15° C./Hr and terminated at 570° C.

The plate so produced exhibited 27200 A/m coersive force (Hc), 0.65 T residual magnetic flux density (Br) and 8.1% elongation. The plate was shaped into a curved configuration of a shadow mask with formation of an electronic beam passage.

A spinodal decomposition type magnet alloy of a composition (5Co-35Cr-Fe in balance) was processed in the same way. The product exhibited 22400 to 29600 A/m coersive force (Hc), 0.52 to 0.78 T residual magnetic flux density (Br) and 8.8% elongation.

Similarly, a product from a spinodal decomposition type magnet alloy of a composition (15Co-20Cr-Fe in balance) exhibited 24000 to 36000 A/m coersive force (Hc), 0.65 to 0.88 T residual magnetic flux density (Br) and 9.3% elongation. A product from a spinodal decomposition type magnet alloy of a composition (12Co-25Cr-Fe in balance) exhibited 24000 to 34400 A/m coersive force (Hc), 0.70 to 0.95 T residual magnetic flux density (Br) and 8.2% elongation.

For comparison, a plate was shaped into a curved configuration of a shadow mask right after the solution treatment. After formation of an electronic beam passage, the sample was subjected to like agings which developed strain on the configuration and caused change in position of the electronic beam passage. The product was thus quite unsuited for use as a shadow mask.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

We claim:

1. A method for producing a shadow mask for a colour cathode ray tube, comprising the steps of:

forming a plate from a spinodal decomposition type magnet alloy which contains 5 to 15 wt% of Co, 20 to 35 wt% of Cr and Fe in balance;

subjecting said plate to solution treatment;

subjecting said plate to a primary aging which is at a maximum temperature of 660° C.±5° C. and brought to termination at a cooling speed of 80° C.±10° C./Hr;

subjecting said plate to a secondary aging which is at a temperature of 635° C.±5° C., brought to termination at a cooling speed of 8° to 20° C./Hr and terminated at a temperature of 560° C.±10° C.; and thereafter shaping said plate into a curved configuration of said shadow mask and forming an aperture therethrough for passage of an electron beam.

2. The method as claimed in claim 1 in which said temperature is maintained for a period from 10 to 15 min during said primary aging.

3. The method as claimed in claim 1 or 2 in which said spinodal decomposition type magnet alloy further contains 0.1 to 2 wt% of at least one of Ti, V, Zr, Nb, Mo, W, Mn, Ni, Si, Cu, Zn and Ta.

* * * * *

UNITED STATES PATENT AND TRADEMARK OFFICE

CERTIFICATE OF CORRECTION

PATENT NO. : 4,683,013

DATED : July 28, 1987

INVENTOR(S) : Iijima et al.

It is certified that error appears in the above-identified patent and that said Letters Patent are hereby corrected as shown below:

IN THE CLAIMS

Claim 1, line 8, delete "maximum".

Signed and Sealed this

Fifteenth Day of March, 1988

*Attest:*

*Attesting Officer*

DONALD J. QUIGG

*Commissioner of Patents and Trademarks*